US007377321B2

(12) United States Patent
Rytlewski

(10) Patent No.: US 7,377,321 B2
(45) **Date of Patent: *May 27, 2008**

(54) TESTING, TREATING, OR PRODUCING A MULTI-ZONE WELL

(75) Inventor: Gary Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 162 days.

This patent is subject to a terminal disclaimer.

(21) Appl. No.: 11/306,879

(22) Filed: Jan. 13, 2006

(65) Prior Publication Data

US 2006/0207764 A1 Sep. 21, 2006

Related U.S. Application Data

(63) Continuation-in-part of application No. 11/081,005, filed on Mar. 15, 2005, now Pat. No. 7,322,417, which is a continuation-in-part of application No. 10/905,073, filed on Dec. 14, 2004.

(51) Int. Cl.
*E21B 34/14* (2006.01)

(52) U.S. Cl. ..... 166/313; 166/386; 166/318

(58) Field of Classification Search ..... 166/250.07, 166/250.17, 373, 375, 386, 318, 332.4, 334.4, 166/313
See application file for complete search history.

(56) References Cited

U.S. PATENT DOCUMENTS 4,099,563 A 7/1978 Hutchison et al.
4,729,432 A 3/1988 Helms
4,967,841 A 11/1990 Murray
5,029,644 A 7/1991 Szarka et al.
5,224,556 A 7/1993 Wilson et al.
5,361,856 A 11/1994 Surjaatmadja et al.
5,765,642 A 6/1998 Surjaatmadja
5,887,657 A * 3/1999 Bussear et al. ..... 166/336
5,988,285 A 11/1999 Tucker
6,009,947 A 1/2000 Wilson et al.
6,186,230 B1 2/2001 Nierode (Continued)

FOREIGN PATENT DOCUMENTS

GB 2375558 A 11/2002

(Continued)

OTHER PUBLICATIONS

Thomson, D.W. and Nazroo, M.F.; "Design and Installation of a Cost-Effective Completion System for Horizontal Chalk Wells Where Multiple Zones Require Acid Stimulation"; Offshore Technology Conference, May 1997, Houston, Texas; SPE 51177 (a revision of SPE 39150).

*Primary Examiner*—Jennifer H Gay
*Assistant Examiner*—David Andrews
(74) *Attorney, Agent, or Firm*—Dan C. Hu; Kevin B. McGroff; Bryan P. Galloway

(57) ABSTRACT

An assembly having plural valves is run into a wellbore having plural zones, where each of the valves is actuatable by dropping a valve-actuating object into the corresponding valve. The valves are successively actuating, in a predetermined sequence, to an open state. The zones are successively tested after actuating corresponding valves to the open state.

18 Claims, 5 Drawing Sheets

U.S. PATENT DOCUMENTS

| | | | |
|---|---|---|---|
| 6,216,785 | B1 | 4/2001 | Achee, Jr. et al. |
| 6,253,861 | B1 | 7/2001 | Carmichael |
| 6,286,599 | B1 | 9/2001 | Surjaatmadja et al. |
| 6,333,699 | B1 | 12/2001 | Zierolf |
| 6,386,288 | B1 | 5/2002 | Snider et al. |
| 6,394,184 | B2 | 5/2002 | Tolman et al. |
| 6,520,255 | B2 | 2/2003 | Tolman et al. |
| 6,536,524 | B1 | 3/2003 | Snider |
| 6,543,538 | B2 | 4/2003 | Tolman et al. |
| 6,575,247 | B2 | 6/2003 | Tolman et al. |
| 6,662,874 | B2 | 12/2003 | Surjaatmadja et al. |
| 6,672,405 | B2 | 1/2004 | Tolman et al. |
| 6,719,054 | B2 | 4/2004 | Cheng et al. |
| 6,725,933 | B2 | 4/2004 | Middaugh et al. |
| 6,759,968 | B2 | 7/2004 | Zierolf |
| 6,761,219 | B2 | 7/2004 | Snider et al. |
| 6,907,936 | B2 | 6/2005 | Fehr et al. |
| 2002/0093431 | A1 | 7/2002 | Zierolf |
| 2002/0158120 | A1 | 10/2002 | Zierolf |
| 2003/0090390 | A1 | 5/2003 | Snider et al. |
| 2003/0127227 | A1 | 7/2003 | Fehr et al. |
| 2004/0040707 | A1 | 3/2004 | Dusterhoft et al. |
| 2004/0050551 | A1 | 3/2004 | Jones |
| 2004/0055749 | A1 | 3/2004 | Lonnes et al. |
| 2004/0118564 | A1 | 6/2004 | Themig et al. |
| 2004/0129422 | A1 | 7/2004 | Themig |
| 2005/0178552 | A1 | 8/2005 | Fehr et al. |
| 2006/0124310 | A1 | 6/2006 | Lopez de Cardenas |

FOREIGN PATENT DOCUMENTS

| | | | |
|---|---|---|---|
| GB | 2386624 | A | 9/2003 |
| GB | 2411189 | A | 8/2005 |
| GB | 2424233 | A | 9/2006 |

* cited by examiner

TESTING, TREATING, OR PRODUCING A MULTI-ZONE WELL

CROSS REFERENCE TO RELATED APPLICATION

This is a continuation-in-part of U.S. Ser. No. 11/081,005, filed Mar. 15, 2005, which is a continuation-in-part of U.S. Ser. No. 10/905,073, filed Dec. 14, 2004, both hereby incorporated by reference.

BACKGROUND

A wellbore can have a plurality of zones. For example, a formation that contains hydrocarbons can have multiple layers that have different characteristics. A wellbore that extends through such a formation will have multiple zones that correspond to the multiple layers.

After a wellbore has been drilled through the formation, the various layers of the formation are perforated by use of perforating guns. Following perforation, testing, such as drillstem testing, is performed. Drillstem testing (DST) is a procedure to determine the productive capacity, pressure, permeability, or extent (or some combination of these characteristics) of a hydrocarbon reservoir in each layer of the formation.

In many cases, testing of multiple zones in a wellbore may be required to be performed independently. To conduct these tests, the lower layer is perforated and then DST tools are run in the hole and that layer is flow tested. The test string is then removed, and a plug is set above the tested layer and below the next layer to be tested. The next layer is then perforated and tested. This is repeated until all of the layers of interest are tested. To flow the well for production, all of the plugs will be milled out. As a result, drillstem testing of multiple zones in a wellbore can be a lengthy process that can take up to several days, which can be costly in terms of labor and equipment costs. Also, lengthy drillstem testing also delays the completion of a wellbore.

SUMMARY OF THE INVENTION

In general, according to an embodiment, a method comprises running an assembly having plural valves into a wellbore having plural zones, each of the valves actuatable by dropping an object into the corresponding valve. The valves are successively actuatable to an open state, and zones are successively tested after actuating corresponding valves to the open state.

Other or alternative features will become apparent from the following description, from the drawings, and from the claims.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
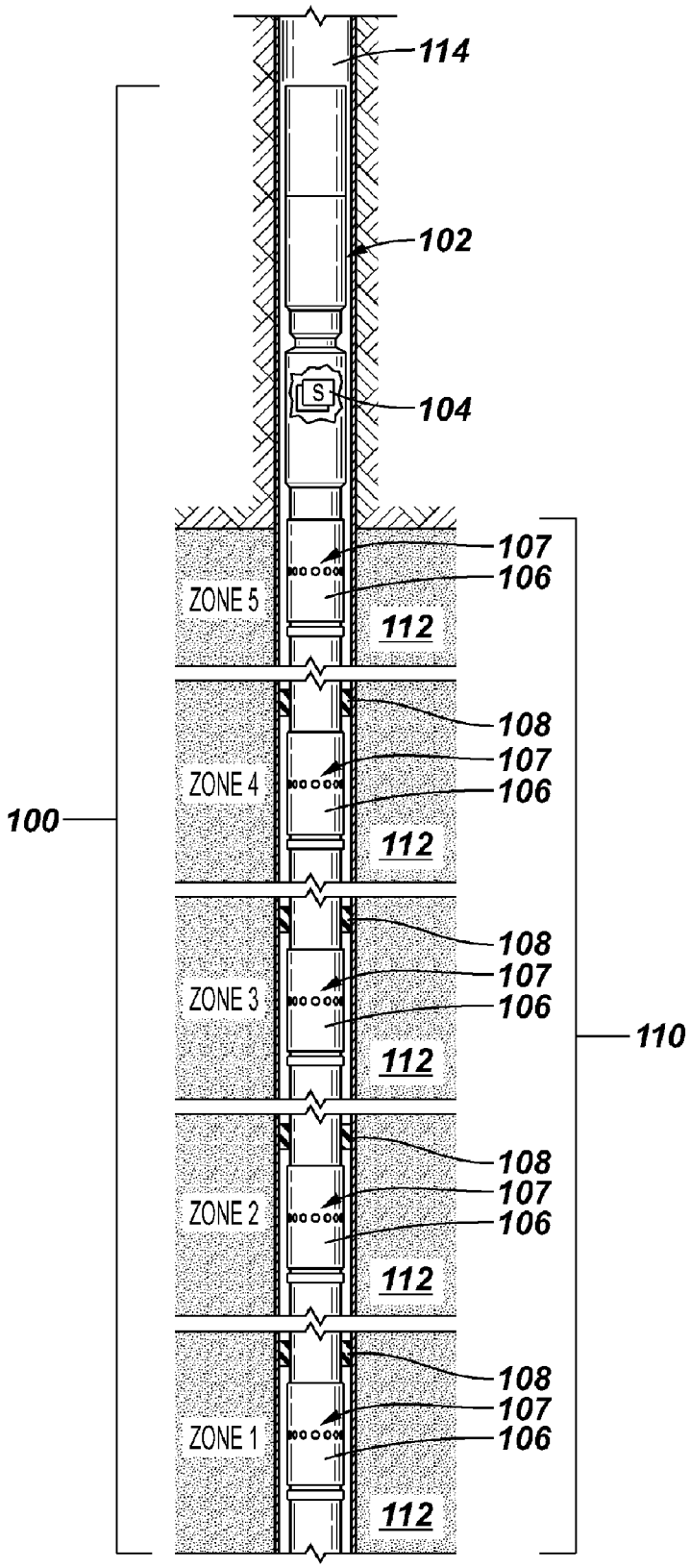
FIG. 1 illustrates an example arrangement of a drillstem testing tool string that includes an assembly of multiple valves for controlling testing of corresponding zones in a wellbore, in accordance with an embodiment.

FIG. 1 shows an example tool string 100, inserted in a wellbore 114, that includes a drillstem testing (DST) tool 102 and an assembly 110 of valves 106 and packers 108, in accordance with an embodiment. The packers 108, when set, are used to isolate multiple zones corresponding to multiple layers 112 of a formation adjacent the wellbore 114. One valve 106 and packer 108 is used for each zone, according to one implementation.

The packers 108 enable each zone to be perforated and then independently and individually tested to determine characteristics of the layer 112 in that zone. The multiple zones are tested in a predetermined sequence by the tool string 100. In successively testing each zone, a corresponding one of the valves 106 is actuated to an open state to enable fluid communication between the respective layer and the interior of the tool string 100 through ports 107 of the corresponding valve 106. The remaining valves 106 in the assembly 110 corresponding to the other zones that are not presently being tested remain closed.

The tool string 100 optionally can also allow treating of the various zones (such as by injecting fracturing fluids that contain proppants) and production of hydrocarbons from the various zones (through the valves 106). For production, the assembly 110 of valves 106 and packers 108 can be left in the wellbore 114, with the drillstem tool 102 substituted with a production string to enable hydrocarbon flow from the formation layer(s) 112 through the production string to the earth surface.

Figure 1A:
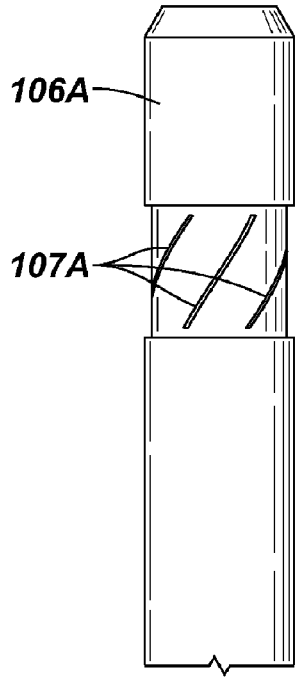
FIG. 1A illustrates an alternative embodiment of a valve that can be used in the drillstem testing tool of FIG. 1.

FIG. 1A depicts an alternative embodiment of a valve 106A that can be substituted for each valve 106 of FIG. 1. The valve 106A has ports that are made up of slots 107A arranged in a helix or at a slanted angle with respect to the longitudinal axis of the valve 106A. At least some portion of the helically or angularly arranged slots 107A can be placed in front of any crack that may be generated in the formation (such as during treatment) so that fluid (e.g., treating fluid) can be fed to the formation crack with a smaller pressure drop and with reduced tortuosity to reduce the likelihood of prematurely screening out near the wellbore.

To perform drillstem testing of a particular zone (that includes a layer 112 under test), a well operator quickly draws down pressure in the wellbore 114 such that a lower pressure is created in the region of the wellbore 114 near the layer 112 under test. The quick pressure drawdown causes a portion of the layer 112 under test near the wellbore 114 to achieve a lower pressure than the rest of the layer 112 under test. After the pressure drawdown has been performed, the wellbore 114 is shut in (in other words, isolated at the well earth surface or at some downhole location in the wellbore 114 by use of an isolation valve), and pressure in the wellbore 114 is allowed to build up due to fluid flow from the formation layer 112 under test into the wellbore 114.

One or more sensors 104 are provided in the DST tool 102 to monitor various characteristics associated with the fluid flow from the layer 112 under test into the wellbore. One or plural of the sensors 104 can be a pressure sensor to monitor pressure in the wellbore 114. The rate at which the pressure builds up in the wellbore 114 after the drawdown and shut-in is an indication of the permeability of the formation layer 112 under test. The various pressure readings taken by the pressure sensor can be recorded and stored locally in the DST tool 102 for later retrieval. Alternatively, the pressure readings can be communicated by a telemetry mechanism over a cable (e.g., electrical cable, fiber optic cable, etc.) to earth surface equipment.

Shut-in of the wellbore 114 after pressure drawdown also causes generation of pressure waves due to the pressure shock associated with the shut-in. The pressure waves are propagated through the formation layer 112 under test. A formation layer 112 may include one or more boundaries. The pressure waves propagated into the formation layer 112 reflect off these boundaries. Reflections from these boundaries can be measured by a pressure or acoustic sensor (or multiple pressure or acoustic sensors), which is (are) part of the sensors 104 in the drillstem tool 102. Measuring the reflected pressure waves allows a determination of where the boundaries in the layer 112 under test are located to identify any fractures or faults in the formation layer 112. Also, the reflected pressure waves can provide an indication of how deep the formation layer 112 extends (depth of the layer 112 under test from the wellbore 114 radially outwardly into the formation layer 112).

Other tests can also be performed by the DST tool 102. In an alternative embodiment, the tool 102 can be another type of testing tool (other than a DST tool).

A benefit offered by the tool string 100 according to some embodiments is that a single run of the tool string 100 is performed for treating, testing, or producing multiple zones in the wellbore 114. Each of the zones can be individually and independently treated, tested, or produced by isolating that zone from the other zones by use of the packers 108. Communication with each zone is achieved by using a corresponding one of the plural valves 106 that are successively opened for treating, testing, or producing corresponding zones. In some embodiments, the tool string 100 may be moved after one zone is tested for the purpose of treating, testing, or producing another zone. The tool string 100 may also avoid the need for wireline, slickline, or coiled tubing intervention to treat, test, or produce multiple zones.

In some embodiments, the valves are opened in a sequence that begins at the bottom of the string with the lowest zone, with the testing proceeding successively upwardly to the other zones above the lowest zone. In a horizontal wellbore, the testing can begin with the most distal zone (the zone farthest away from the earth surface), with the testing proceeding successively to more proximal zones (zones closer to the earth surface). In other embodiments, the sequence can start at the uppermost zone or most proximal zone.

To open a particular valve according to some embodiments, a free-falling or pumped-down object (such as a ball) is deployed from the earth surface into the wellbore 114 and into an interior bore of the tool string 100. Such an object is referred to as a valve-actuating object. For example, the valve-actuating object that is dropped into the wellbore 114 for actuating a valve 106 can be a generally spherical ball. In other implementations, other types of valve-actuating objects can be used.

In some embodiments, valve-actuating objects of the same dimension may be used (although differently sized valve-actuating objects may be used in other embodiments) to actuate corresponding valves 106 to an open state. Valve-actuating objects of the "same dimension" refer to valve-actuating objects that vary less than approximately 0.125 inches from each other. The dimension can be a diameter for a generally spherical ball, for example.

Use of valve-actuating objects of the same dimension to open plural respective valves 106 is accomplished by providing the valves 106 each having at least two different states: a first state ("object pass-through state") in which the valve-actuating object dropped into the bore of the tool string 100 is allowed to pass through the valve 106; and a second state ("object-catching state") in which a valve-actuating object dropped into the bore of the tool string 100 is caught by that valve and seated in a receiving element of the valve 106. A valve 106 that has an object pass-through state and an object-catching state is referred to as a "multi-state object-actuated valve."

Once a valve-actuating object is caught in a valve 106, the valve 106 can be hydraulically actuated from a closed position to an open position. In accordance with an embodiment, the lowermost valve 106 is first placed into the object-catching state such that a first valve-actuating object dropped into the bore of the tool string 100 is caught by the lowermost valve 106. In some other implementations, the lowermost valve 106 can be implemented with a standard valve rather than a multi-state object-actuated valve. After the lowermost valve 106 is opened, testing can be performed with respect to the formation layer 112 adjacent the lowermost valve 106.

Opening of the lowermost valve 106 causes the next higher valve 106 (referred to as the "second valve") to transition from the object pass-through state to the object-catching state. Thus, a second valve-actuating object that is dropped into the bore of the tool string 100 can be caught by the second valve 106 to enable actuation of the second valve 106 to an open state so that the formation layer 112 adjacent the second valve 106 can be tested.

Opening of the second valve 106 causes the valve (referred to as the "third valve") above the second valve 106 to transition from the object pass-through state to the object-catching state. This enables the third valve to be opened to perform testing of the next zone adjacent the third valve 106. The process is successively repeated until the uppermost valve 106 has been opened to allow testing of the uppermost zone.

Figure 2A:
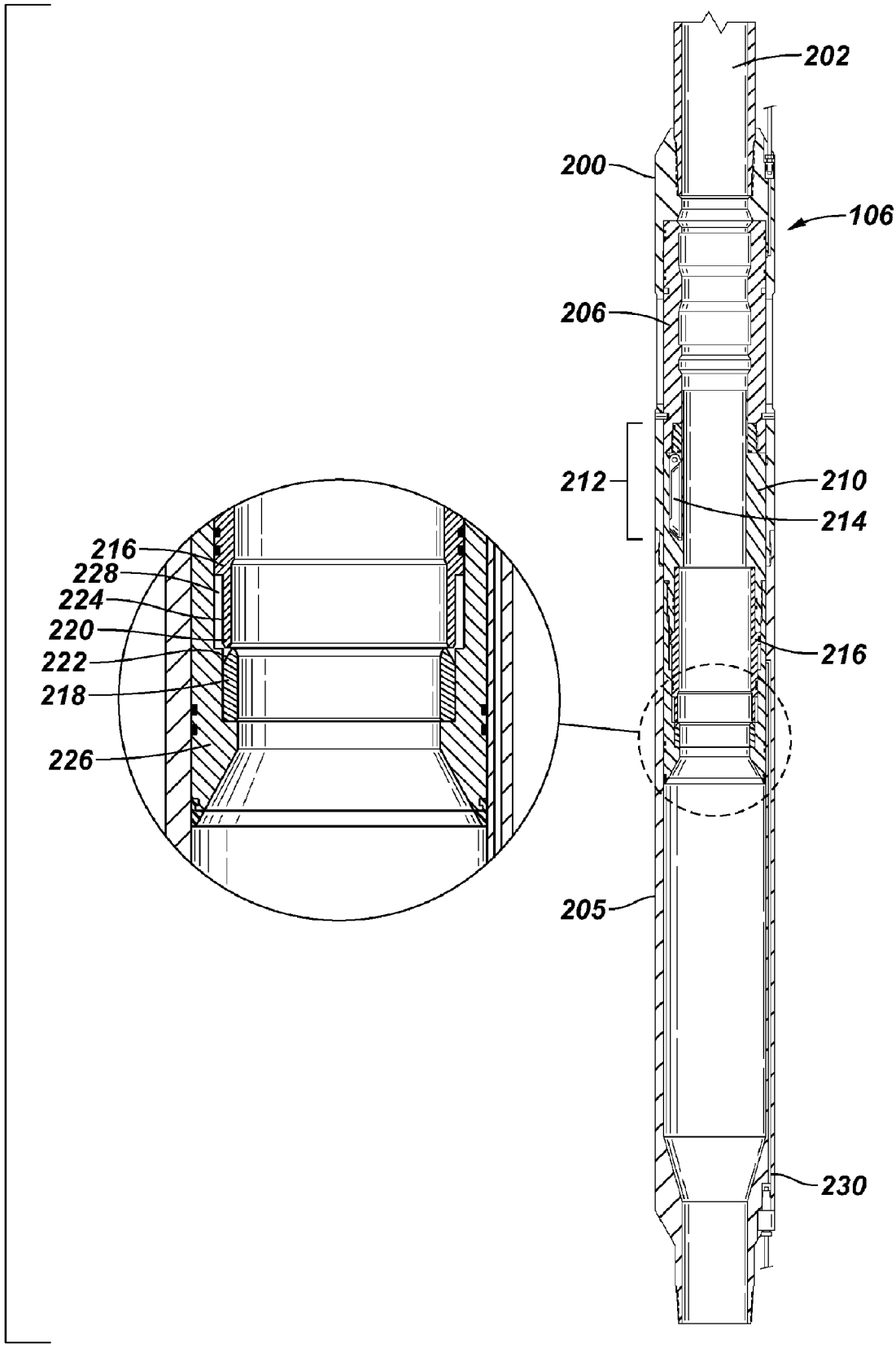
FIGS. 2A-2B illustrate various an object pass-through state and an object-catching state of a valve used in the tool string of FIG. 1, according to an embodiment.
Figure 2B:
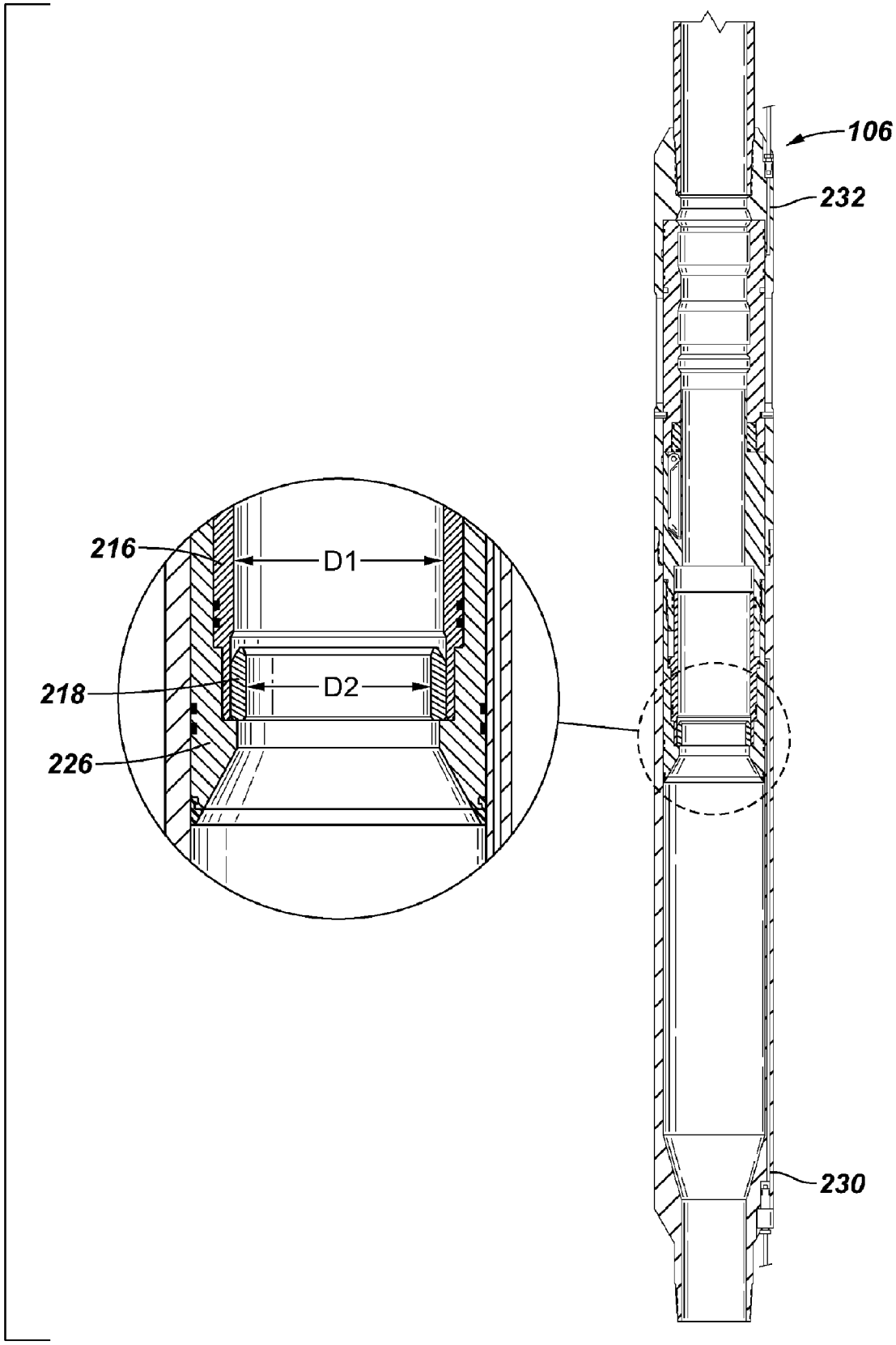

FIGS. 2A-2B illustrate two different states of a valve 106: the object pass-through state (FIG. 2A) and the object-catching state (FIG. 2B). The valve 106 includes a generally cylindrical upper housing section 200 that is coaxial with a longitudinal axis of the valve 106. The upper housing section 200 includes an upper opening 202 to communicate fluids (well fluid formation fluid, etc.) with the portion of the tool string 100 (FIG. 1) that is located above and that is attached to the upper housing section 200. At its lower end, the upper housing section 200 is coaxial with and is connected to a generally cylindrical an intermediate housing section 204, which in turn is connected to a lower housing section 205. Although depicted as being multiple housing sections, the housing sections can be collectively referred to as a "housing" of the valve 106.

The valve 106 includes a valve sleeve 206 that is coaxial with the longitudinal axis and that is constructed to move longitudinally within the valve. The central passageway of the valve sleeve 206 forms part of the central bore 208 of the valve 106. Seals (not shown), such as O-ring seals, are provided to seal off radial openings (not shown) in the upper housing section 200. As further described below, when the sleeve 206 moves in a downward direction to open the valve 106, radial openings in the upper housing section 200 are exposed to place the valve 106 in an open state, a state in which fluid communication occurs between the central bore 208 of the valve 106 and the region that surrounds the valve 106 (annular region of the wellbore 114). In other embodiments, instead of the valve sleeve 206, other moveable members can be used for exposing the radial openings (or other forms of openings) of the valve 106.

At its lower end, the valve sleeve 206 is connected to the upper end of a mandrel 210. The mandrel 210 is attached to a flapper valve 212 that includes a flapper 214. In the position illustrated in each of FIGS. 2A-2B, the flapper valve 212 is in its open position to enable passage of a valve-actuating object through the central bore 208 of the valve 106. As described further below, after the valve-actuating object is seated in the valve 106 and the valve 106 has been actuated to the open state, the flapper 214 is allowed to pivot to its closed position to prevent fluid from the lower zones to flow upward during pressure drawdown in the wellbore for testing a corresponding zone adjacent the valve 106 (or due to fluid flows during production or treatment of the corresponding zone). The flapper valve 212 is one example type of isolating member for isolating the valve-actuating object seated in the valve 106 from being unseated. Other types of isolating members such as ball valves can be used in other embodiments.

In yet another embodiment, the valve-actuating object once landed in the valve 200 (such as in the C-ring 218 described below) causes the valve-actuating object to be captured such that the valve-actuating object seals in both directions. In such an embodiment, the flapper valve 212 can be omitted.

The lower end of the mandrel 210 is connected to the upper end of a piston 216. The piston 216 is generally coaxial with the longitudinal axis. In the FIG. 2A position, the piston 216 is its inactive position. A lower end 220 of the piston 216 contacts a slanted surface 222 of a C-ring 218. In response to actuation of the piston 216 that causes the piston 216 to move downwardly, the lower end 220 of the piston 216 pushes against the slanted surface 222 of the C-ring 218 to enable an engagement member 224 of the piston 216 to slide between the C-ring and a fixed member 226 (see position of FIG. 2B). This causes the C-ring to project radially inwardly (compressed) into the central bore 208 of the valve 106, such that the inner diameter of the central bore 208 in the region defined by the C-ring 218 is smaller than the diameter of the central bore 208 in other sections of the valve 106. For example, the inner diameter D2 in the region defined by the C-ring 218 (when pushed radially inwardly as depicted in FIG. 2B) is smaller than the inner diameter D1 defined by the piston 216.

The position of FIG. 2B corresponds to the object-catching state of the valve 106, while the position of FIG. 2A corresponds to the object pass-through state. A valve-actuating object is allowed to pass through the valve 106 in the FIG. 2A position, while the valve-actuating object will be caught by the C-ring 218 in the object-catching state of FIG. 2B. The C-ring 218 is considered to be an example type of receiving element for receiving the valve-actuating object when in the object-catching state. The valve-actuating object sealingly seats on the C-ring 218 to allow increased pressure to be applied against the valve-actuating object and C-ring 218 for the purpose of opening the valve.

In the object pass-through state, the C-ring is considered to be uncompressed, whereas in the object-catching state, the C-ring is considered to be compressed. The C-ring 218 is one example of a compressible element that can be compressed by the piston 216. In other embodiments, other types of compressible elements can be used, such as a collet.

The piston 216 is actuated downwardly by a pressure differential created against a chamber 228 that contains atmospheric pressure or some other low pressure. On the other side of the piston 216, pressure is applied through a control passageway 230 defined in the lower housing section 205. The control passageway 230 communicates pressure to one side of the piston 216, such that an increase in the pressure of the control passageway 230 causes the piston 216 to be moved downwardly to engage the C-ring 218 and to push the C-ring radially inwardly to the FIG. 2B position. The control passageway 230 is coupled to a control passageway 232 (defined in the upper housing section 200) of the next valve below the depicted valve 106. The control passageway 232 of the valve 106 depicted in FIGS. 2A-2B is in turn coupled to the control passageway 230 in the next upper valve 106. In other words, in a chain of valves 106, the control passageways 230, 232 of each pair of successive valves 106 are coupled to each other.

The control passageway 232 is initially at a low pressure, such as an atmospheric pressure equal to the pressure contained in the chamber 228. In this manner, the piston 216 is not actuated. However, when the valve below the depicted valve 106 is actuated to an open position (due to downward movement of the valve sleeve 206), the control passageway 232 in the upper housing section 200 is exposed to wellbore pressure which is communicated to the control passageway 230 of the next higher valve. The wellbore pressure in the control passageway 230 creates a pressure differential across the piston 216 such that the piston 216 is allowed to move downwardly to actuate the C-ring 218.

In an alternative embodiment, instead of using the piston 216 and C-ring 218 to achieve an object-catching state of the valve 106, a collet sleeve can be used instead, where the collet sleeve is initially in an expanded state to achieve the object pass-through state. The collet sleeve can be compressed, by the piston 216, for example, to achieve the object-catching state.

FIGS. 3A-3D illustrate several positions of the valve 106 after the valve 106 has transitioned to the object-catching state of FIG. 2B. To actuate the valve 106 to an open state, a valve-actuating object 300 is dropped into the central bore 208 of the valve 106. The valve-actuating object 300 is caught by the C-ring 218, which forms a seal such that an upper portion of the central bore 208 is isolated from the lower portion of the central bore 208. As a result, pressure in the upper portion of the central bore 208 can be increased to apply downward force on an assembly that includes the valve sleeve 206, mandrel 210, and piston 216.

Figure 3A:
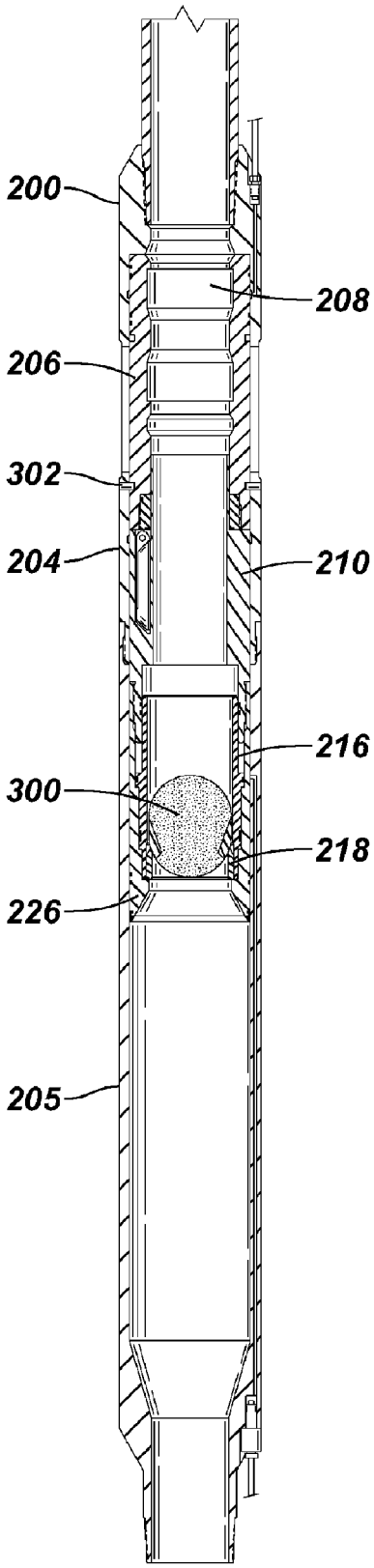
FIGS. 3A-3D illustrate a valve used in the tool string of FIG. 1 in several positions, according to an embodiment.
Figure 3B:
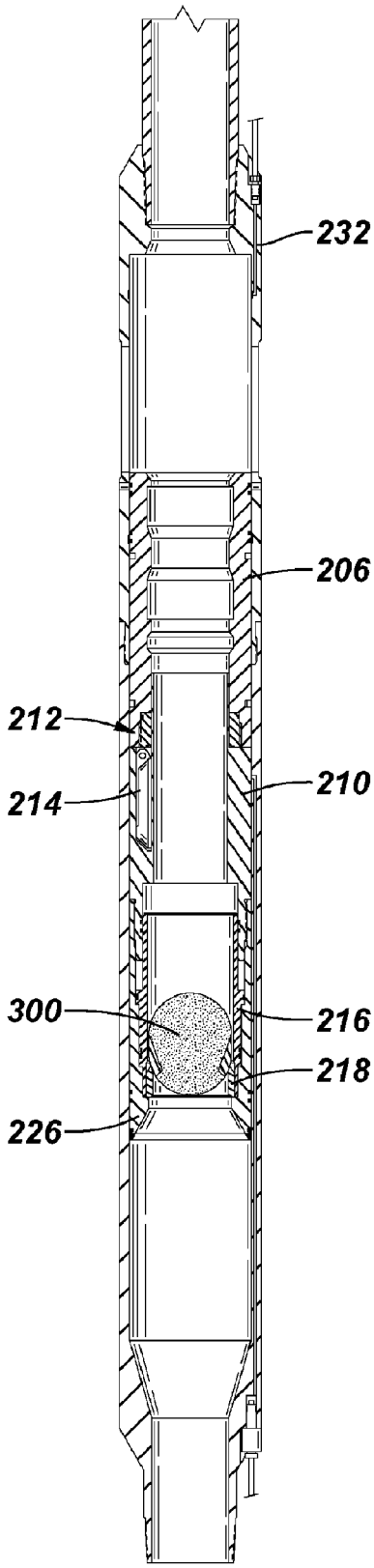

The downward pressure applied on the valve sleeve 206 causes shearing of one or plural shear pins 302 (which releasably connects the valve sleeve 206 to the lower housing section 204, such that downward movement of the valve sleeve 206 can be achieved (see FIG. 3B). The downward movement of the valve sleeve 206 exposes radial ports (not shown) in the upper housing section 200 to enable fluid communication between the annulus region outside the valve 106 and the central bore 208 of the valve 106. Also, the control passageway 232 in the upper housing section 200 is exposed to the central bore 208 such that wellbore pressure can be communicated into the control passageway 232 and also to the control passageway 230 in the next higher valve 106, as discussed above.

Figure 3C:
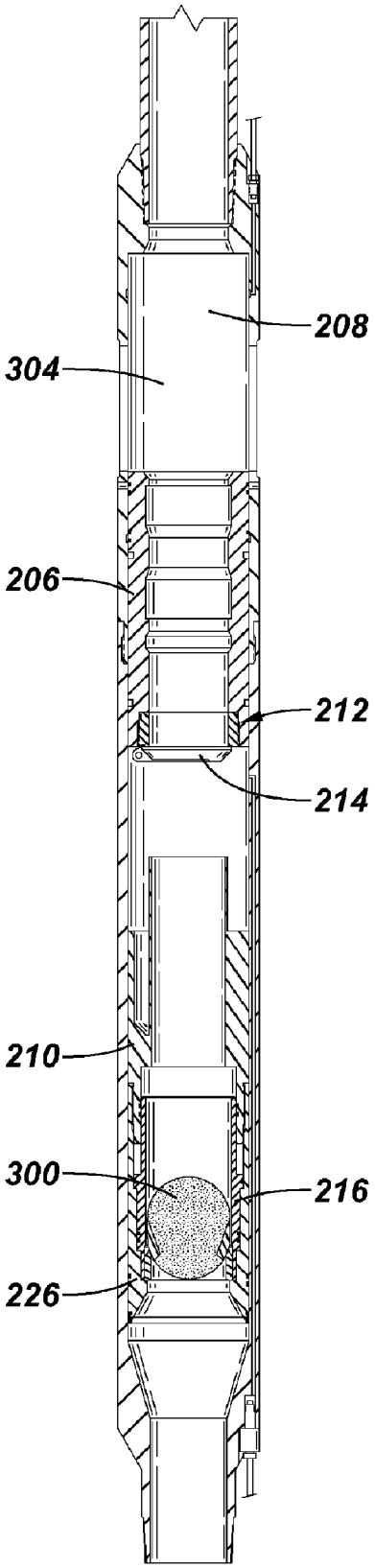

The mandrel 210 in the position of FIG. 3B is still connected to the valve sleeve 206. The connection between the valve sleeve 206 and the mandrel 210 is a releasable connection provided by a shear mechanism that can be sheared by further downward pressure against the valve-actuating object 300. A stop is provided by the inner surface of the lower housing section 204 to prevent further downward movement of the valve sleeve 206, such that continued downward pressure applied against the valve-actuating object 300 will cause the shear mechanism connecting the mandrel 210 to the valve sleeve 206 to shear. Shearing of the shear mechanism connecting the valve sleeve 206 and the mandrel 210 causes the mandrel 210 to separate from the valve sleeve 206, as depicted in FIG. 3C. In the FIG. 3B position, the flapper 214 is maintained in the open position by the mandrel 210. However, when the mandrel 210 is separated from the valve sleeve 206 and moves away from the flapper 214, the biasing mechanism of the flapper valve 212 allows the flapper 214 to pivot to the closed position as depicted in FIG. 3C. When the flapper 214 is closed, pressure in a region 304 of the central bore 208 above the flapper valve 212 is isolated from pressure in the region 306 between the flapper valve 212 and the valve-actuating object 300. As a result, any pressure drawdown that causes a pressure drop in the region 304 above the flapper valve 212 is isolated from the valve-actuating object 300 such that the valve-actuating object 300 is not un-seated during the testing procedure.

Closing of the flapper valve 212 can also allow production of formation fluids into the valve 106 while the production flow is isolated from zones below the open valve 106.

Figure 3D:
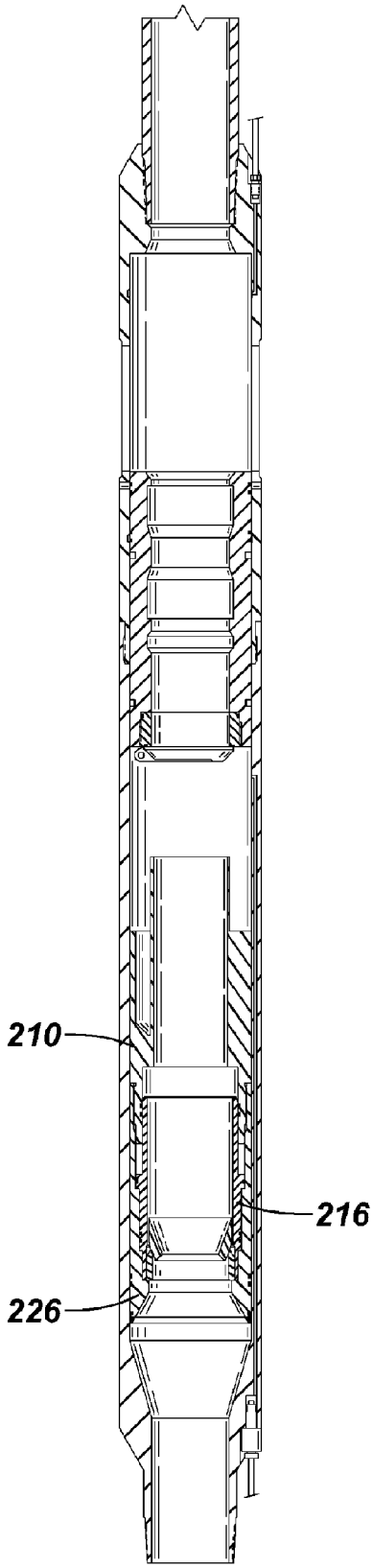

In some embodiments, the valve-actuating object 300 is formed of a material that dissolves or melts at a temperature between the wellbore temperature and the fluid temperature used to pump down the valve-actuating object 300. The valve-actuating object 300 disappears or otherwise disintegrates enough to allow flow to pass through the C-ring 218 and piston 216 some time after the valve 106 has opened, as depicted in FIG. 3D. Dissolving of the valve-actuating object 300 allows the zones to be bullheaded and the well to be killed for safe removal of the tool string 100.

The embodiments discussed above involve the opening of a lower valve to cause the next higher valve to transition to the object-catching state so that the next higher valve can be actuated open. In an alternative embodiment, the opening of an upper valve causes the next lower valve to transition to the object-catching state.

In yet another embodiment, the flapper valve 212 can be closed first before actuation of the valve sleeve 206 to expose radial openings in the upper housing section 200. First closing of the flapper valve 212 allows inflow testing prior to opening of the valve 106 to the formation. Inflow testing allows fluid flow rate for a given downhole pressure to be determined. After the inflow test, further pressure can be applied to actuate the valve sleeve 206 to expose the radial openings of the upper housing section 200.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method comprising:

running an assembly having plural valves into a wellbore having plural zones, each of the valves actuatable by dropping a valve-actuating object into the corresponding valve;

successively actuating, in a predetermined sequence, the valves to an open state; and successively testing the zones after actuating corresponding valves to the open state, wherein actuating each given valve to the open state comprises:

dropping a corresponding valve-actuating object into the given valve;

catching the valve-actuating object in the given valve;

applying pressure against the valve-actuating object to move a member in the given valve to expose one or more openings of the given valve to enable fluid flow between an inner bore of the given valve and a region outside the given valve; and actuating the given valve from a first state to a second state, wherein the given valve when in the first state allows the valve-actuating object to pass through the given valve, and wherein the given valve when in the second state allows the valve-actuating object to be caught by the given valve.

2. The method of claim 1, wherein successively testing the zones comprises successively performing drillstem testing of the zones.

3. The method of claim 2, wherein running the assembly into the wellbore comprises running the assembly that further comprises a drillstem test tool having one or plural sensors to measure one or more characteristics of the zones.

4. The method of claim 3, further comprising using the one or plural sensors to measure at least one of pressure and acoustic waves.

5. The method of claim 1, wherein actuating the given valve from the first state to the second state is in response to a neighboring valve opening.

6. The method of claim 5, further comprising communicating increased fluid pressure in a control passageway from the neighboring valve to the given valve in response to the neighboring valve opening, the increased fluid pressure to move a piston in the given valve to actuate the given valve from the first state to the second state.

7. The method of claim 6, further comprising compressing a compressible element in response to the piston moving, the compressible element when compressed providing the second state.

8. The method of claim 7, wherein compressing the compressible element comprises compressing a C-ring or a collet.

9. The method of claim 1, wherein each zone is tested after opening of a corresponding one of the valves and before opening a next one of the valves in the predetermined sequence.

10. A method comprising:

running an assembly having plural valves into a wellbore having plural zones, each of the valves actuatable by dropping a valve-actuating object into the corresponding valve;

successively actuating, in a predetermined sequence, the valves to an open state; and successively testing the zones after actuating corresponding valves to the open state, wherein actuating each given valve to the open state comprises:

dropping a corresponding valve-actuating object into the given valve;

catching the valve-actuating object in the given valve;

applying pressure against the valve-actuating object to move a member in the given valve to expose one or more openings of the given valve to enable fluid flow between an inner bore of the given valve and a region outside the given valve; and after actuating the given valve to the open state, closing an isolating member in each valve to isolate the valve-actuating object from a portion of a bore in the valve; and wherein closing the isolating member prevents fluid from lower zones from flowing to the corresponding zone adjacent the given valve.

11. A system for use in a wellbore, comprising:

a plurality of valves, each valve having a first state and a second state;

a plurality of valve-actuating objects to be dropped into the wellbore to successively open corresponding valves, each valve when in the first state allowing valve-actuating objects to pass through, and each valve when in the second state catching a corresponding valve-actuating object; and a testing tool coupled to the plurality of valves to test corresponding zones of the wellbore proximal corresponding valves.

12. The system of claim 11, wherein the testing tool comprises one or plural sensors to measure characteristics of each of the zones.

13. The system of claim 11, wherein the testing tool successively tests corresponding zones as each valve is actuated open in a predetermined sequence.

14. The system of claim 11, further comprising packers to isolate the zones to enable the zones to be independently and separately tested.

15. The system of claim 11, wherein each given one of the valves has a compressible element that when uncompressed provides the first state of the given valve, and that when compressed provides the second state of the given valve.

16. The system of claim 15, wherein the compressible element is compressed in response to increased pressure applied due to a neighboring valve opening.

17. The system of claim 11, wherein each valve has slots to enable fluid communication between an inside of the valve and an outside of the valve, the slots arranged in a helix or at an angle with respect to a longitudinal axis of the valve.

18. A method comprising:

running an assembly having plural valves into a wellbore having plural zones, each of the valves actuatable by dropping a valve-actuating object into the corresponding valve, and each valve having a first state that allows the valve-actuating object to pass through, and each valve having a second state to catch a corresponding valve-actuating object;

successively actuating, in a predetermined sequence, the valves to an open state; and successively testing, treating, or producing the zones after actuating corresponding valves to the open state.

* * * * *